US012765739B2

(12) United States Patent
Zhang et al.

(10) Patent No.: US 12,765,739 B2
(45) Date of Patent: Oct. 20, 2026

(54) DOCKING STATION, CLEANING DEVICE, AND CLEANING SYSTEM

(71) Applicants: BEIJING XIAOMI MOBILE SOFTWARE CO., LTD., Beijing (CN); Dreame Innovation Technology (Suzhou) Co., Ltd., Suzhou (CN)

(72) Inventors: Tiantian Zhang, Beijing (CN); Lu Han, Beijing (CN); Peiheng Zhu, Beijing (CN); Tao Heng, Suzhou (CN); Bing Bai, Suzhou (CN); Liqing Xiong, Suzhou (CN); Bojian Xu, Suzhou (CN)

(73) Assignees: BEIJING XIAOMI MOBILE SOFTWARE CO., LTD., Beijing (CN); Dreame Innovation Technology (Suzhou) Co., Ltd., Suzhou (CN)

( * ) Notice: Subject to any disclaimer, the term of this patent is extended or adjusted under 35 U.S.C. 154(b) by 310 days.

(21) Appl. No.: 17/900,672

(22) Filed: Aug. 31, 2022

(65) Prior Publication Data

US 2023/0320554 A1 Oct. 12, 2023

(30) Foreign Application Priority Data

Apr. 8, 2022 (CN) ..... 202220816082.7

(51) Int. Cl.
*A47L 11/40* (2006.01)

(52) U.S. Cl.
CPC ..... *A47L 11/4088* (2013.01); *A47L 11/4027* (2013.01); *A47L 11/4083* (2013.01); *A47L 2201/026* (2013.01)

(58) Field of Classification Search
CPC ..... A47L 11/4088; A47L 11/4027; A47L 11/4083; A47L 11/4091; A47L 2201/026;
(Continued)

(56) References Cited

U.S. PATENT DOCUMENTS

2018/0368646 A1* 12/2018 Buehler ..... A47L 11/4016
2020/0022553 A1* 1/2020 Gill ..... A47L 9/1436
(Continued)

FOREIGN PATENT DOCUMENTS

CN 111839375 A 10/2020
CN 212679039 U 3/2021
(Continued)

OTHER PUBLICATIONS

English translation of Cn 215838750U (Year: 2022).*
(Continued)

*Primary Examiner* — David S Posigian
*Assistant Examiner* — Sukwoo James Chang
(74) *Attorney, Agent, or Firm* — Arch & Lake LLP; Hao Tan; Shen Wang

(57) ABSTRACT

A docking station includes a station body and a liquid feeding assembly. The station body has a docking region and guiding assembly on a side of the station body. The guiding assembly is in the docking region. The guiding assembly is configured to be in guiding fit with a mating assembly of a cleaning device. The liquid feeding assembly is on the station body and includes a liquid feeding connector. The liquid feeding connector has a liquid outlet oriented toward the docking region. The liquid outlet is configured to be butted and communicated with a connector of the cleaning device under the guiding fit of the guiding assembly and the mating assembly.

13 Claims, 7 Drawing Sheets

(58) Field of Classification Search
CPC ..... A47L 2201/028; A47L 2201/02; A47L 2201/024
See application file for complete search history.

(56) References Cited

U.S. PATENT DOCUMENTS

| | | | | |
|---|---|---|---|---|
| 2020/0367714 | A1* | 11/2020 | Wang | A47L 11/4083 |
| 2022/0047139 | A1* | 2/2022 | Jeong | A47L 11/4011 |

FOREIGN PATENT DOCUMENTS

| | | | | | |
|---|---|---|---|---|---|
| CN | 113261893 | A | | 8/2021 | |
| CN | 113442770 | A | * | 9/2021 | A47L 11/4091 |
| CN | 113545717 | A | * | 10/2021 | A47L 11/4011 |
| CN | 215227304 | U | * | 12/2021 | A47L 11/40 |
| CN | 215838750 | U | | 2/2022 | |
| CN | 216135789 | U | | 3/2022 | |
| DE | 112020001864 | T5 | * | 4/2022 | A47L 11/28 |
| KR | 20210032482 | A | | 3/2021 | |

OTHER PUBLICATIONS

English translation of Cn 113442770A (Year: 2021).*
English translation of Cn 215227304U (Year: 2021).*
English translation of De 112020001864T5 (Year: 2022).*
English translation of CN 113545717A (Year: 2021).*
OA of RU Application No. 2022123230 dated on Mar. 10, 2023 with English translation,(11p).
The extended European search report issued in Application No. 22193167.8 dated May 16, 2023, (112p).
Notice of Reasons for Refusal issued on JP application No. 2022-138119 dated on Nov. 14, 2023 with English translation, (6p).
Korean Intellectual Property Office, "Request for the Submission of an Opinion", issued in Application No. 10-2022-0109248 dated on Jun. 28, 2024, with English Translation, (17p).

* cited by examiner

DOCKING STATION, CLEANING DEVICE, AND CLEANING SYSTEM

CROSS-REFERENCE TO RELATED APPLICATION

This application is based on and claims priority to the Chinese Patent Application No. 202220816082.7 filed on Apr. 8, 2022, the entire disclosure of which is incorporated herein by reference for all purposes.

BACKGROUND

A conventional household cleaning system generally includes a docking station and a cleaning device, and the docking station may replenish the cleaning device with a cleaning liquid, such as water and a cleaning agent, so that the cleaning device can perform cleaning continuously. However, when the conventional docking station feeds the liquid to the cleaning device, it is difficult for the cleaning device to be accurately aligned so as to be butted with the docking station, which tends to cause water leakage, so that it takes a long time to replenish the cleaning device with the cleaning liquid, thus resulting in low cleaning efficiency.

SUMMARY

The present disclosure relates to a field of cleaning tools, and in particular, to a docking station, a cleaning device, and a cleaning system.

Embodiments of a first aspect of the present disclosure provide a docking station, for use in conjunction with a cleaning device. The docking station may include: a station body having a docking region and a guiding assembly on a side of the station body, the guiding assembly being in the docking region, the docking region being configured to receive the cleaning device, the guiding assembly being configured to be in guiding fit with a mating assembly of the cleaning device; and a liquid feeding assembly on the station body and including a liquid feeding connector, the liquid feeding connector having a liquid outlet oriented toward the docking region. The liquid outlet is configured to be butted and communicated with a connector of the cleaning device under the guiding fit of the guiding assembly and the mating assembly.

Embodiments of a second aspect of the present disclosure further provide a cleaning device, for use in conjunction with a docking station. The cleaning device may include: a cleaning body, the cleaning body including a mating assembly on a side of the cleaning body, the mating assembly being configured to be in guiding fit with a guiding assembly of the docking station; and a liquid guiding assembly on the cleaning body and including a connector, the connector being configured to be butted and communicated with a liquid feeding connector of the docking station. The cleaning device is configured to enter a docking region of the docking station, and the connector is configured to be butted and communicated with a liquid outlet of the liquid feeding connector of the docking station under the guiding fit of the guiding assembly and the mating assembly.

Embodiments of a third aspect of the present disclosure further provide a cleaning system that may include a docking station and a cleaning device. The cleaning device includes: a cleaning body including a mating assembly on a side of the cleaning body; and a liquid guiding assembly on the cleaning body and comprising a connector. The docking station includes: a station body having a docking region and a guiding assembly on a side of the station body, the guiding assembly being in the docking region, the docking region being configured to receive the cleaning device, the guiding assembly being configured to be in guiding fit with the mating assembly of the cleaning device; and a liquid feeding assembly on the station body, the liquid feeding assembly including a liquid feeding connector, the liquid feeding connector having a liquid outlet oriented toward the docking region. The cleaning device is configured to enter the docking region of the docking station, and the connector is configured to be butted and communicated with the liquid outlet of the liquid feeding connector of the docking station under the guiding fit of the guiding assembly and the mating assembly.

DETAILED DESCRIPTION

Figure 1:
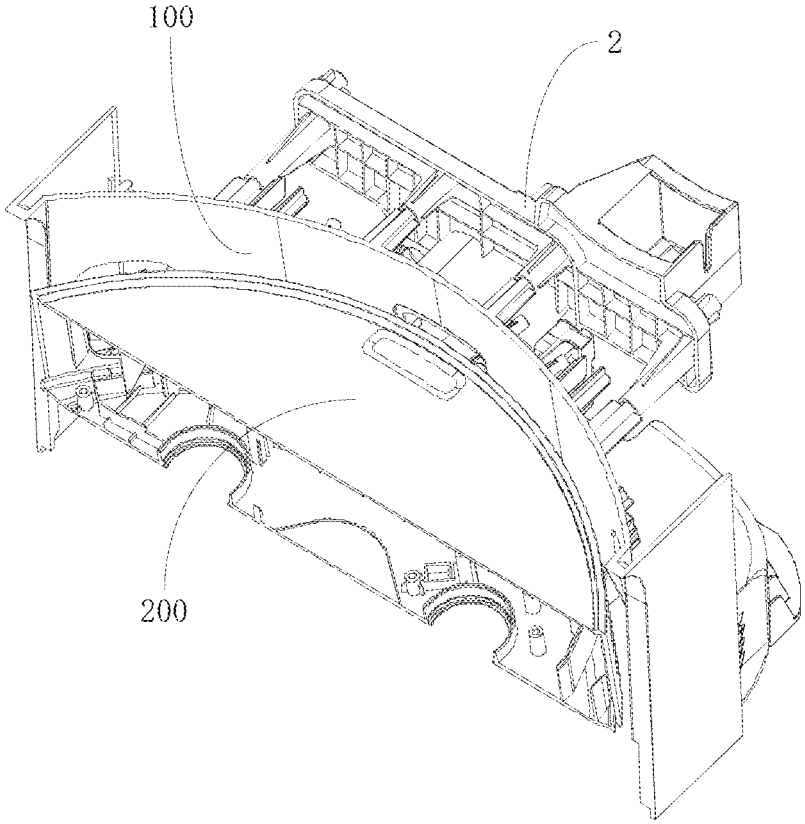
FIG. 1 is a partial schematic view of a cleaning system according to an embodiment of the present disclosure.

The technical solutions in the present disclosure will be described clearly and completely below with reference to the accompanying drawings. Obviously, the embodiments described are some rather than all of the embodiments of the present disclosure. The present disclosure will be described in detail below with reference to the accompanying drawings and embodiments. It is to be noted that the embodiments in the present disclosure and features in the embodiments may be combined with each other without conflict.

It is to be noted that terms such as "first" and "second" used in the descriptions, claims and the drawings of the present disclosure are intended to distinguish similar objects, but are not intended to describe a specific sequence or order.

In the present disclosure, terms indicating orientations or directions, such as "up, down, top, bottom" are generally refer to orientations or directions shown in the drawings or to a component itself oriented in a vertical, perpendicular, or gravity direction, unless otherwise specified. Similarly, to facilitate understanding and description, terms "inner, outer" refer to the inside and the outside with respect to a contour of each component. The above terms are not intended to limit the present disclosure.

The embodiments of the present disclosure provide a docking station 100. The docking station 100 may be configured to automatically replenish a cleaning device 200 with a cleaning liquid to enable the cleaning device 200 to perform cleaning continuously. As shown in FIGS. 1 to 4, the docking station 100 includes a station body 1 and a liquid feeding assembly 2. The station body 1 includes a docking region 15 on a side of the station body 1, i.e., a side facing towards the cleaning device 200 when the cleaning device 200 is driving into the docking station 100. For example, the docking region 15 may be a recess or a cavity in the side of the station body 1. The docking region 15 may be used to receive the cleaning device 200, so that the docking station 100 can replenish the cleaning device 200 with the cleaning liquid when the cleaning device 200 is parked in the docking region 15. The docking body 1 further includes a guiding assembly 10 on the side where the docking region 15 is, and the guiding assembly 10 is in the docking region 15 (for example, in a rear portion of the docking region 15, to be further discussed below). That is, the guiding assembly 10 is on the side of the docking body 1 where the docking region 15 is, and in the rear portion of the docking region 15. The guiding assembly 10 is configured to be in guiding fit with a mating assembly 40 of the cleaning device 200. Herein, the guiding fit of two members means that the two members come into fit while being guided and also for guiding of the assemblies including the two members. The liquid feeding assembly 2 is on the station body 1 (for example, on another opposite side of the station body 1, i.e., a side facing away from the docking region 15) and configured to provide the cleaning liquid. Specifically, the liquid feeding assembly 2 includes a liquid feeding connector 21. A liquid outlet 211 of the liquid feeding connector 21 is arranged toward the docking region 15. When the cleaning device 200 needs to be replenished with the cleaning liquid, the cleaning device 200 may enter the docking region 15, and under the guiding fit of the guiding assembly 10 and the mating assembly 40, the liquid outlet 211 of the liquid feeding connector 21 may be smoothly butted and communicated with a connector 51 of the cleaning device 200, so as to transport the cleaning liquid into the cleaning device 200 to realize the automatic replenishment of the cleaning liquid. With the guiding fit of the guiding assembly 10 and the mating assembly 40, the liquid feeding connector 21 and the connector 51 can be fast and accurately aligned when communicated. Therefore, a liquid replenishing channel can be communicated fast and well, which effectively improves the liquid replenishment efficiency of the cleaning device 200 and enables high overall cleaning efficiency.

Figure 2:
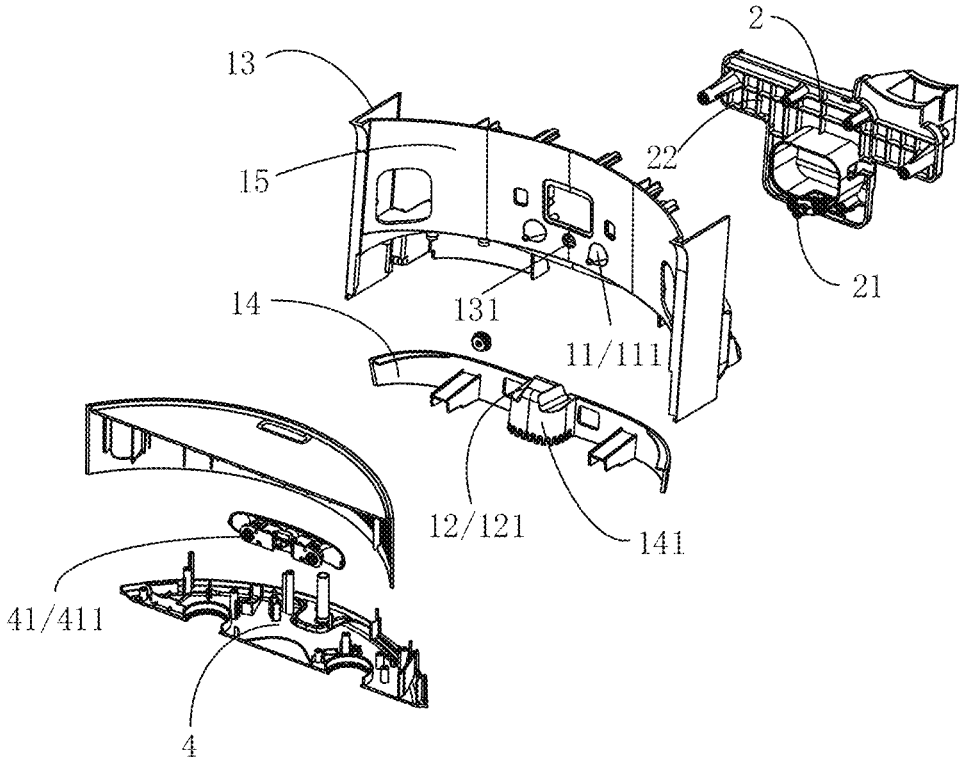
FIG. 2 is an exploded schematic view of the cleaning system in FIG. 1.
Figure 10:
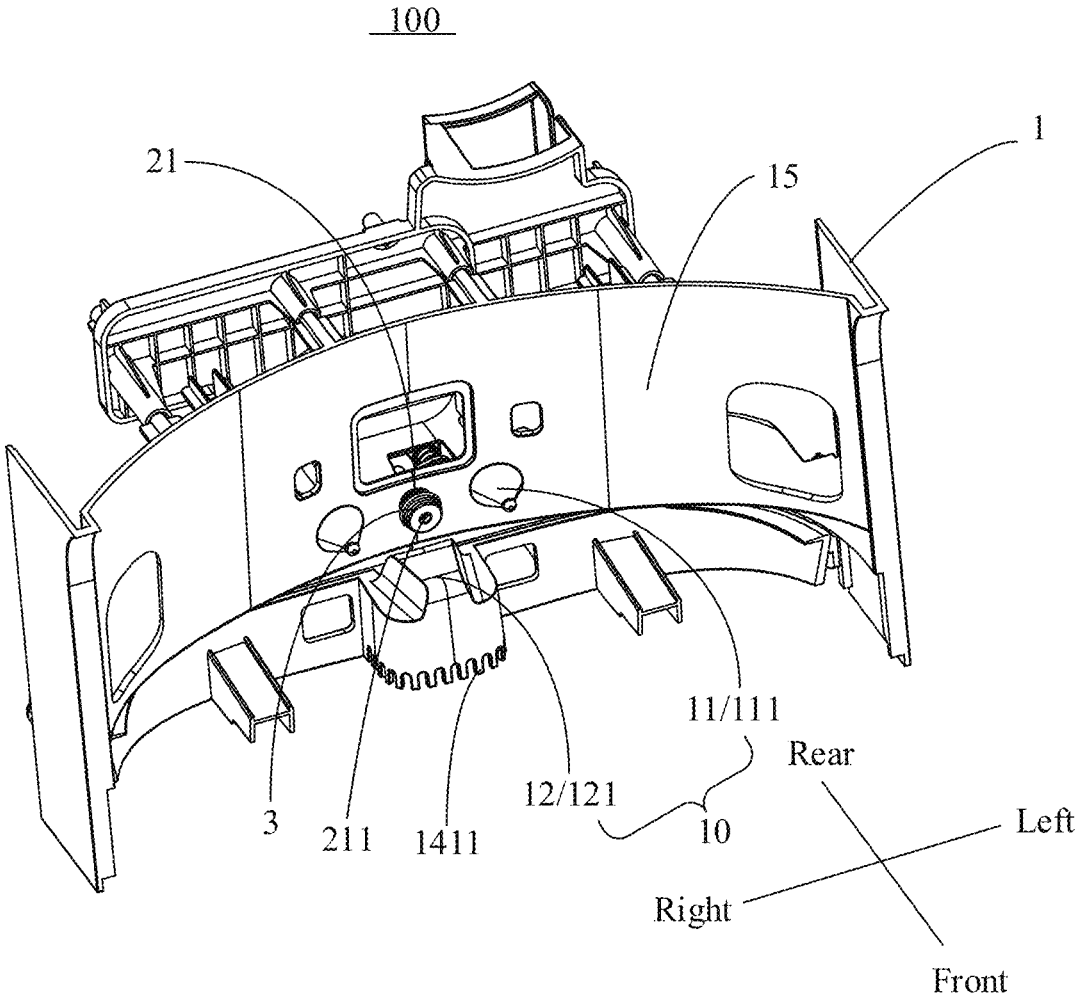
FIG. 10 is a schematic view of a docking station in FIG. 1.

In an embodiment, as shown in FIG. 2 and FIG. 10, the guiding assembly 10 includes a first guiding structure 11, the mating assembly 40 of the cleaning device 200 includes a first mating structure 41, and at least one side of the docking region 15 is open. When entering the docking region 15, the cleaning device 200 may drive into the docking region 15 from an opening of the docking region 15, so as to be butted with the docking station 100. Specifically, the first guiding structure 11 includes a guiding protrusion 111 protruding from the side of the station body 1 where the docking region 15 is into the docking region 15, and extending toward the opening. A shape of the docking region 15 roughly matches with a shape of the cleaning device 200. For example, when the cleaning device 200 is a circular sweeper, the docking region 15 may be roughly in a circular shape. When the docking station 100 operates normally, the cleaning device 200 drives into the docking region 15 from a front side of the station body 1. Thus, the opening is in a front portion of the docking region 15, the guiding assembly 10 is in a rear portion of the docking region 15, and the guiding protrusion 111 extends in a front-rear direction, so as to guide the entry of the cleaning device 200, so that the cleaning device 200 can be well located at a preset position in the docking region 15 with a correct attitude, and hence the liquid feeding connector 21 and the connector 51 can be well butted and communicated. The following is a description of the orientation and direction of the docking station 100. Unless otherwise specified, the opening is in the front portion of the docking region 15 as a reference.

Figure 3:
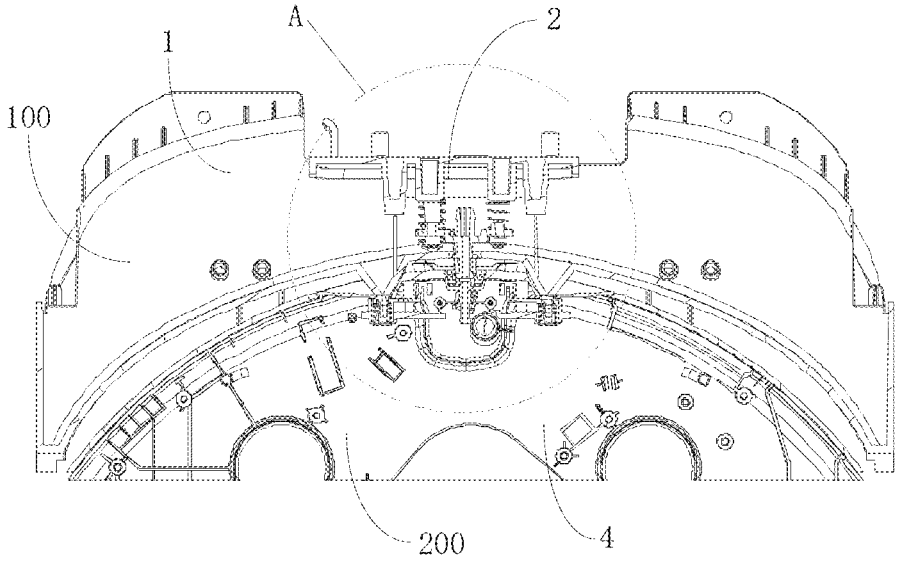
FIG. 3 is a sectional schematic view of the cleaning system in FIG. 1.
Figure 4:
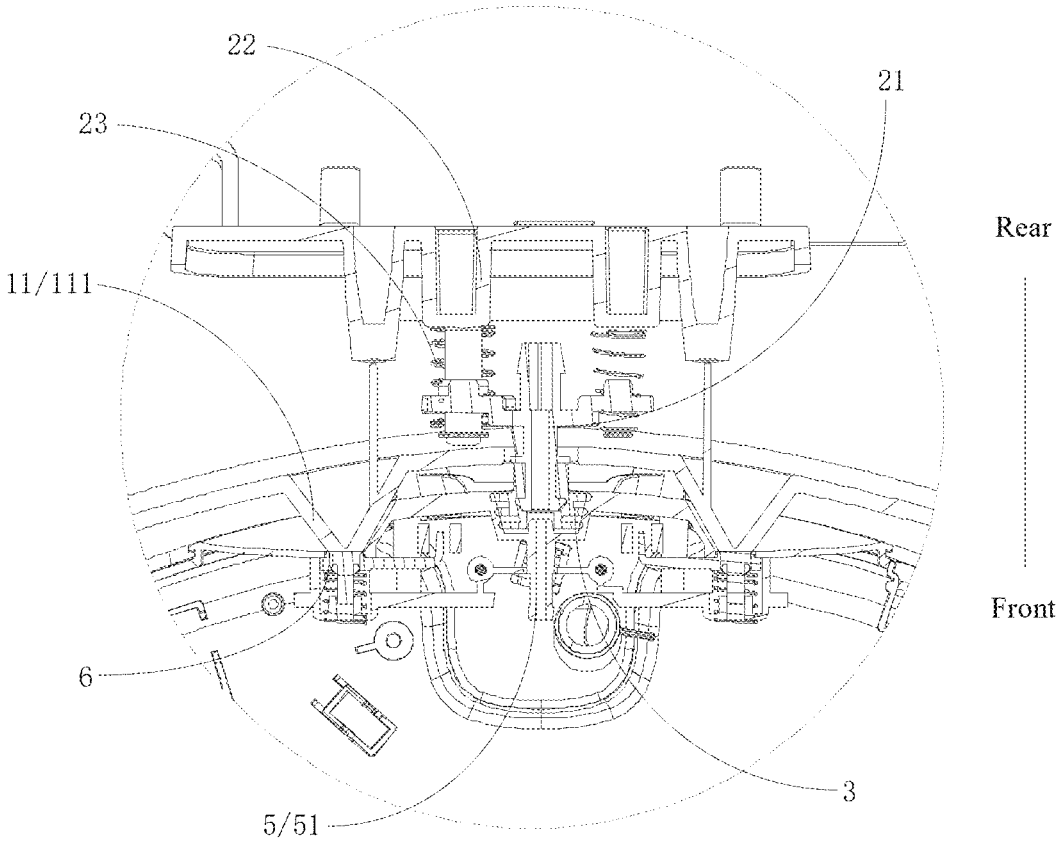
FIG. 4 is an enlarged schematic view of detail A in FIG. 2.

Further, as shown in FIG. 3 and FIG. 4, the guiding protrusion 111 is tapered. A cross section of the guiding protrusion 111 decreases along a direction from the side of the station body 1 where the docking region 15 is toward the opening, i.e., along a direction from rear to front of the station body 1, so that when the guiding protrusion 111 is inserted into the first mating structure 41 for guiding, the insertion is smooth. Moreover, the first mating structure 41 includes a guiding groove 411, and as the guiding protrusion 111 is inserted into the guiding groove 411 of the cleaning device 200, the docking station 100 comes into a close fit with the cleaning device 200, and the cleaning device 200 will not tend to slide (transversely, i.e., perpendicularly to the front-rear direction) relative to the docking station 100 and hence be stable.

In some embodiments, a plurality of guiding protrusions 111 may be provided. The plurality of guiding protrusions 111 are arranged along a left-right direction of the station body 1. A plurality of guiding grooves 411 are also provided and in a one-to-one correspondence with the plurality of guiding protrusions 111. The docking station 100 and the cleaning device 200 are connected through the guiding fit between the plurality of guiding protrusions 111 and the plurality of guiding grooves 411, so that the cleaning device 200 is parked accurately, and thus the liquid feeding connector 21 and the connector 51 are communicated fast.

Figure 6:
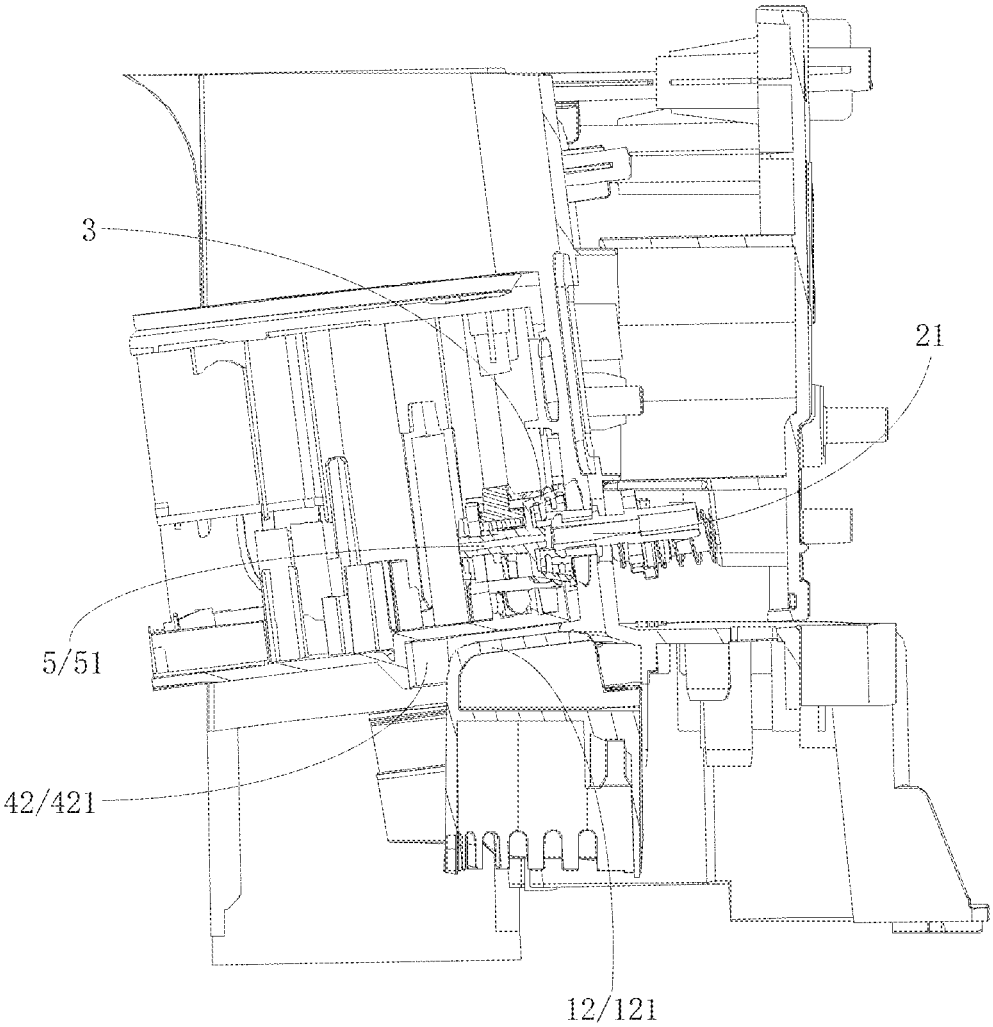
FIG. 6 is yet another sectional schematic view of the cleaning system in FIG. 1.

In some embodiments, as shown in FIG. 6 and FIG. 10, the guiding assembly 10 includes a second guiding structure 12, and the mating assembly 40 includes a second mating structure 42. The second guiding structure 12 is configured to be in guiding fit with the second mating structure 42 of the cleaning device 200. Specifically, the second guiding structure 12 is at a bottom of the docking region 15, so as to guide the cleaning device 200 at the bottom.

Specifically, as shown in FIG. 2, the station body 1 includes a base 13 and a cleaning bracket 14. The cleaning bracket 14 is detachably arranged to the base 13. The docking region 15 is defined by the base 13. The cleaning bracket 14 is located on a rear side of the docking region 15. The second guiding structure 12 is on the cleaning bracket 14, and protrudes from the cleaning bracket 14 to be below the docking region 15. That is, the second guiding structure 12 is at the bottom of the docking region 15. When driving into the docking region 15, the cleaning device 200 is guided to drive into the preset position with the correct attitude through the guiding fit of the second guiding structure 12 at the bottom of the docking region 15 and the second mating structure 42 of the cleaning device 200, so that the liquid feeding connector 21 and the connector 51 are well butted and communicated.

Figure 5:
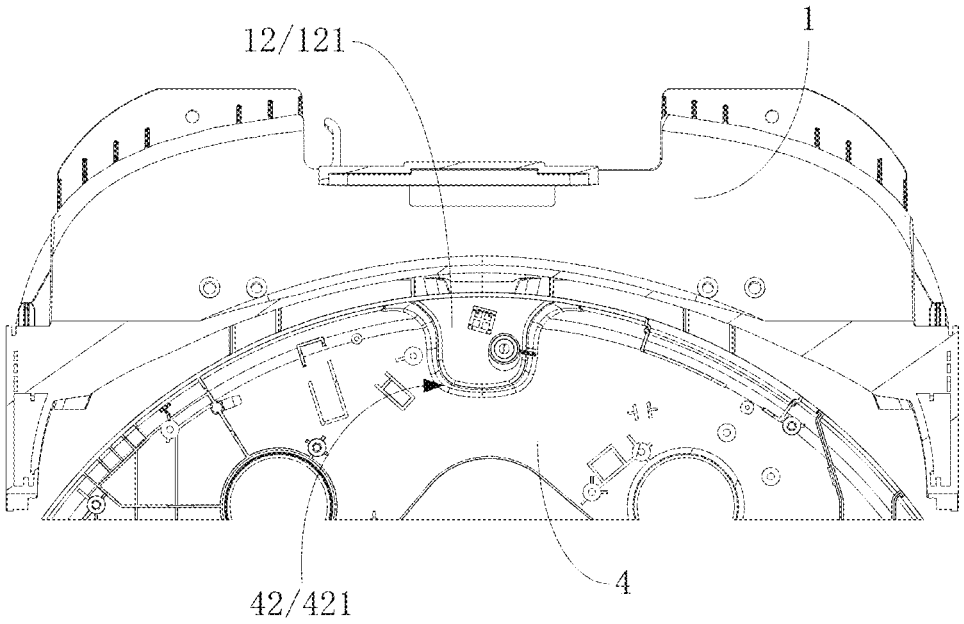
FIG. 5 is another sectional schematic view of the cleaning system in FIG. 1.

In some embodiments, as shown in FIG. 5, one of the second guiding structure 12 and the second mating structure 42 is a guiding boss 121, and the other one of the second guiding structure 12 and the second mating structure 42 is a guiding chute 421 to be in guiding fit with the guiding boss 121. Through the guiding fit of the guiding boss 121 and the guiding chute 421, the cleaning device 200 is guided to the preset position, and a parking position of the cleaning device 200 is precise.

Moreover, the docking station 100 may be configured to replenish the cleaning device 200 with the cleaning liquid, and also be configured to clean cleaning parts of the cleaning device 200 when the cleaning device 200 is parked in the docking region 15. Specifically, the base 13 includes a cleaning tank, and the cleaning tank is located in the docking region 15. In order to reuse the sewage in the cleaning tank that has cleaned the cleaning parts, the cleaning bracket 14 includes a filter 141. The filter 141 at least partially extends into the docking region 15 to protrude from a bottom of the cleaning tank, for filtering and recycling the sewage in the cleaning tank.

In some embodiments, as shown in FIG. 2 and FIG. 10, the cleaning bracket 14 is arc-shaped and surrounds the rear side of the docking region 15. The filter 141 is on a side of the cleaning bracket 14 facing toward the docking region 15. The filter 141 has a tank shape and has an opening facing downwards to the bottom of the cleaning tank. The filter 141 includes a plurality of filtering strips 1411 spaced apart from each other at the opening, and a gap between each two adjacent filtering strips 1411 defines a filtering channel, so that the sewage can enter the filter 141 through the filtering channel, so as to be filtered. The second guiding structure 12 is configured as the guiding boss 121 and protrudes outwards from a bottom of the filter 141, i.e., protruding upwards. Further, the second mating structure 42 includes a guiding chute 421. When the cleaning device 200 drives into the docking station 100, the guiding boss 121 can be right engaged into the guiding chute 421 of the cleaning device 200, so as to guide a moving direction of the cleaning device 200.

The docking station 100 may include only one of the first guiding structure 11 and the second guiding structure 12. Certainly, the docking station 100 may also include both the first guiding structure 11 and the second guiding structure 12. With the two guiding structures, when the cleaning device 200 drives into the docking station 100, the alignment is precise, the liquid feeding connector 21 and the connector 51 are butted fast, and the connection effect is great, so that the cleaning efficiency is high. For example, the guiding boss 121 of the docking station 100 is located in the middle of the cleaning bracket 14 and two guiding protrusions 111 are provided. The two guiding protrusions 111 are located on two sides of the guiding boss 121 respectively and are symmetrical with respect to each other. When the cleaning device 200 drives into the docking region 15, under the action of the guiding protrusion 111 and the guiding groove 411, the cleaning device 200 can be limited and guided in the left-right direction of the station body 1 and a driving direction of the cleaning device 200, and under the guiding fit of the guiding boss 121 and the guiding chute 421, the cleaning device 200 can be limited and guided in an up-down direction of the station body 1 and the driving direction of the cleaning device 200. The cleaning device 200 can be limited in all directions after driving into the docking region 15. Therefore, the alignment accuracy can be fully guaranteed, enabling the connection between the liquid feeding connector 21 and the connector 51 to be reliable.

Moreover, in order to ensure the sealing reliability at the junction between the liquid feeding connector 21 and the connector 51, the docking station 100 further includes a sealing member 3. Specifically, one end of the sealing member 3 is fitted over an end of the liquid feeding connector 21 where the liquid outlet 211 is. When the cleaning device 200 is parked in the docking region 15, at least part of the connector 51 of the cleaning device 200 may extend into the sealing member 3 from the other end of the sealing member 3, so as to be communicated with the liquid feeding connector 21.

For example, the sealing member 3 has a first end and a second end opposite to each other along a length direction of the sealing member 3. The length direction herein may refer to a direction from the liquid feeding connector 21 to the connector 51. Specifically, the length direction of the sealing member 3 in FIG. 4 may refer to the front-rear direction of the station body 1. The first end of the first sealing member 3 is fitted over the liquid feeding connector 21, and the second end of the first sealing member 3 is connected to the connector 51, so that the junction between the liquid feeding connector 21 and the connector 51 is sealed by the sealing member 3, so as to prevent water leakage at the junction.

As shown FIG. 2 and FIG. 4, the liquid feeding assembly 2 includes a liquid feeding bracket 22, and the liquid feeding bracket 22 is connected to both the base 13 and the cleaning bracket 14 of the station body 1. The base 13 of the station body 1 has a through hole 131, and the liquid feeding connector 21 is on the liquid feeding bracket 22 and may pass through the through hole 131 into the docking region 15, so as to be connected with a butt joint (i.e., the connector 51) of the cleaning device 200. Certainly, the liquid feeding assembly 2 further includes a liquid storage tank, and the cleaning liquid is stored in the liquid storage tank. In some embodiments, the liquid feeding connector 21 is connected to a liquid feeding source. For example, the liquid feeding connector 21 may be directly connected to a tap, so that it is convenient to replenish the liquid (for example, water in this case), and there is no need to provide the liquid storage tank. Thus, the docking station 100 can have a small volume.

Further, in order to ensure a reliable connection, the liquid feeding assembly 2 further includes an elastic retractable member 23. The elastic retractable member 23 has two ends along its retractable direction, and the two ends of the elastic retractable member 23 are connected to the liquid feeding bracket 22 and the liquid feeding connector 21 respectively, so that the liquid feeding connector 21 and the connector 51 have a flexible connection when butted with each other, which prevents damages to the liquid feeding connector 21. The elastic retractable member 23 may be a retractable spring. Two retractable springs may be arranged on two sides of the liquid feeding connector 21 respectively. Moreover, after the liquid feeding connector 21 passes through the through hole 131 of the station body 1, the liquid feeding connector is just located in the middle of the two guiding protrusions 111, so that the liquid feeding connector 21 will not be deflected to either side during the butting, and thus is stable.

The embodiments of the present disclosure further provide a cleaning device 200. The cleaning device 200 is configured to be used in conjunction with the docking station 100. Specifically, as shown in FIG. 3 and FIG. 4, the cleaning device 200 includes a cleaning body 4 and a liquid guiding assembly 5. The cleaning body 4 includes a mating assembly 40 on a side of the cleaning body 4, i.e., a side opposite to the docking station 100 when the cleaning device 200 is driving into the docking station 100. The mating assembly 40 is configured to be in guiding fit with the guiding assembly 10 of the docking station 100. The liquid guiding assembly 5 is on the cleaning body 4 and includes a connector 51. The connector 51 is configured to be butted and communicated with the liquid feeding connector 21 of the docking station 100, so as to replenish the cleaning device 200 with the cleaning liquid. Under the guiding fit of the guiding assembly 10 and the mating assembly 40, the cleaning device 200 can enter the docking region 15 of the docking station 100 smoothly, and the connector 51 can be butted and communicated with the liquid outlet 211 of the liquid feeding connector 21 of the docking station 100, so that the liquid can be introduced into the connector 51 through the liquid feeding connector 21 from a liquid storage tank or a liquid feeding source, so as to enter the cleaning device 200 for storage. Thus, the cleaning device 200 can perform cleaning after replenishment of the cleaning liquid, and hence has high cleaning efficiency.

It may be understood that the cleaning device 200 may further include a detachable liquid storage container or a liquid storage chamber in the cleaning body 4. The cleaning liquid is introduced through the connector 51 into the liquid storage chamber or the liquid storage container for storage, so as to be used by the cleaning device 200 during the cleaning.

Figure 8:
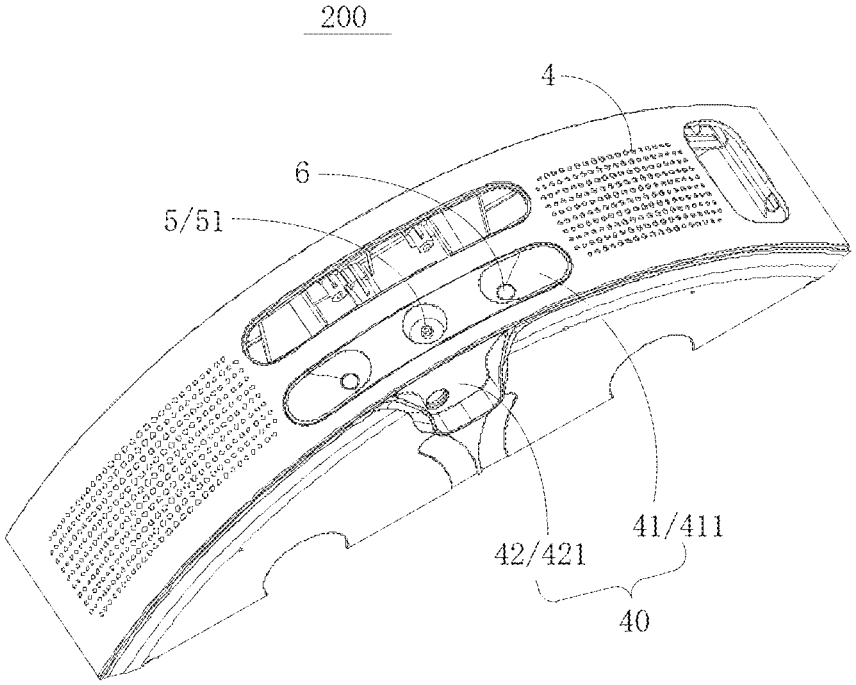
FIG. 8 is a schematic view of a cleaning device in FIG. 1.

In an embodiment, as shown in FIG. 2 and FIG. 8, the mating assembly 40 includes a first mating structure 41, and the first mating structure 41 is configured to be in guiding fit with the first guiding structure 11 of the docking station 100. A direction in which the cleaning device 200 drives into the docking region 15 of the docking station 100 is a forward direction. The first mating structure 41 includes the guiding groove 411, and the guiding groove 411 is recessed from a front side of the cleaning body 4, i.e. the side of the cleaning body 4 opposite to the station body 1 in the forward direction of the cleaning device 200, that is, a part of the front side of the cleaning body 4 is recessed to form the guiding groove 411, so that the guiding protrusion 111 in the rear portion of the docking region 15 of the docking station 100 can be inserted into the guiding groove 411 for guiding.

It should be noted that "front" and "rear" of the cleaning device 200 and the docking station 100 are defined separately herein. For example, the "front" of the cleaning device 200 is opposite to the "front" of the docking station 100, as shown in FIGS. 9 and 10.

Figure 9:
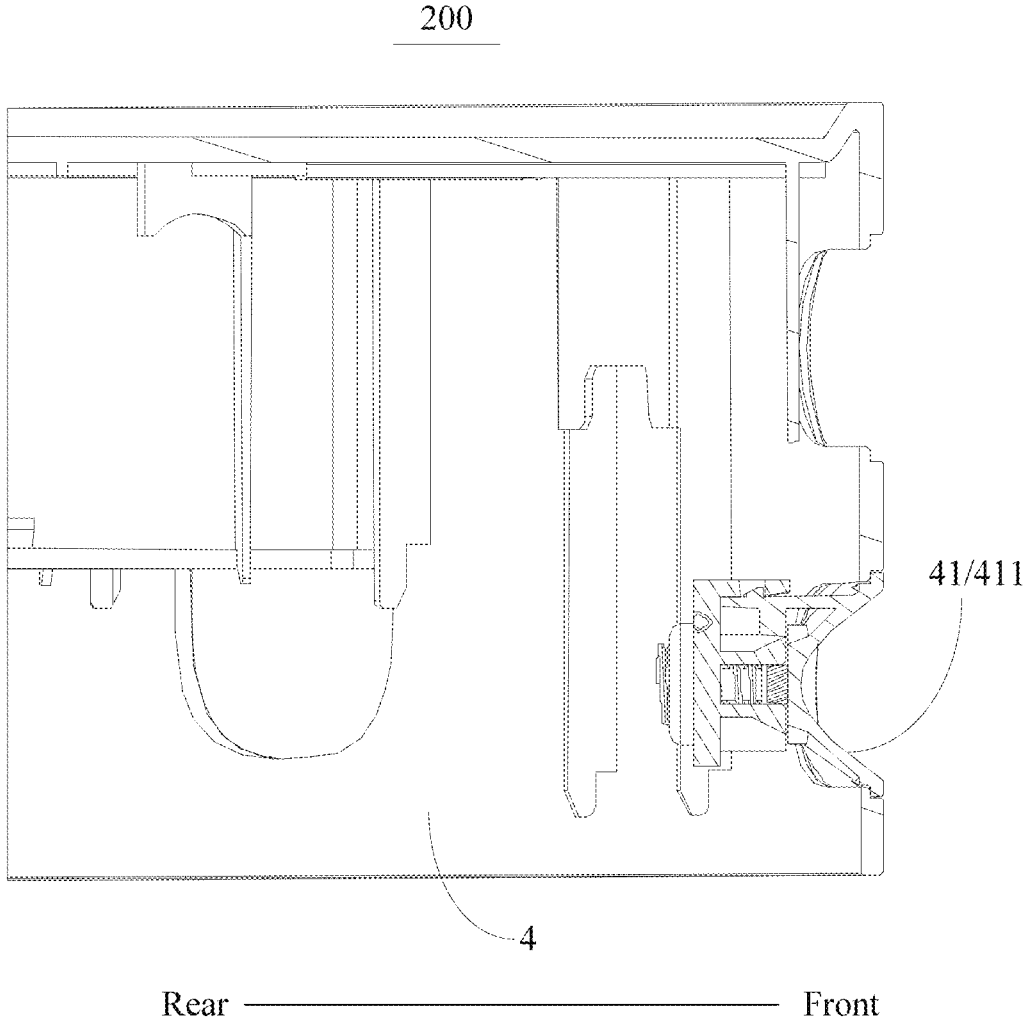
FIG. 9 is a sectional schematic view of the cleaning device in FIG. 8.

In some embodiments, as shown in FIG. 8 and FIG. 9, a cross section of the guiding groove 411 increases along the forward direction of the cleaning device 200. The guiding groove 411 matches with the guiding protrusion 111 in shape. As shown in FIG. 9, the guiding groove 411 is in a shape of a trumpet, and a flaring end of the guiding groove 411 is oriented toward the outside of the cleaning body 4. As the cleaning device 200 drives into the docking region 15, the guiding protrusion 111 and the guiding groove 411 come into a close fit, so that the cleaning device 200 is stable and less shaky in the docking region 15.

Moreover, in order to make the liquid replenishment of the cleaning device 200 intelligent, as shown in FIG. 8, the cleaning device 200 further includes a sensor 6, and the sensor 6 is located at a bottom of the guiding groove 411. When the cleaning device 200 is parked in place in the docking region 15 of the docking station 100, the guiding protrusion 111 of the docking station 100 may abut against the sensor 6, so as to trigger the sensor 6 to send a detection signal. In some embodiments, the cleaning body 4 may further include a controller and a pump body. The controller is electrically connected to both the sensor 6 and the pump body. The pump body is communicated with the connector 51. When the cleaning device 200 is parked in the docking region 15 and the guiding protrusion 111 abuts against the sensor 6, that is, the cleaning device 200 is parked in place, the sensor 6 may send the detection signal to the controller, the controller controls the pump body to start operating, and the pump body may provide a suction force, so that the liquid at the docking station 100 can flow into the connector 51 from the liquid feeding connector 21 of the docking station 100 and enter the cleaning device 200 for storage, so as to realize the automatic liquid replenishment.

In some embodiments, the mating assembly 40 may include a second mating structure 42. The second mating structure 42 is at a bottom of the cleaning body 4 and configured to be in guiding fit with the second guiding structure 12 of the docking station 100. With the guiding fit of the second mating structure 42 and the second guiding structure 12, the cleaning device 200 can be accurately parked in the docking region 15. Specifically, as shown in FIG. 8, the second mating structure 42 includes a guiding chute 421, the guiding chute 421 is at a front end of the bottom of the cleaning body 4, and the guiding chute 421 extends along a front-rear direction of the cleaning body 4. That is, the guiding chute 421 is formed by removing a part of the front side and a part of the bottom of the cleaning body 4, and the part of the front side of the cleaning body 4 and the part of the bottom of the cleaning body 4 are adjacent. The guiding chute 421 is configured to be in guiding fit with the guiding boss 121 of the docking station 100.

It can be understood that the two embodiments may also be combined. With the plurality of guiding fit structures, the cleaning device 200 can be accurately aligned when entering the docking station 100, so that the connection between the connector 51 and the liquid feeding connector 21 is reliable and the liquid feeding efficiency is high.

Further, in order to facilitate the connection between the connector 51 and the liquid feeding connector 21, the connector 51 includes a connecting pipe body 511 communicated with the liquid feeding connector 21 and a receiving portion 512 at an end of the connecting pipe body 511. An opening of the receiving portion 512 is oriented toward the front side of the cleaning body 4, and at least part of the connecting pipe body 511 may extend into the receiving portion 512 to be butted with the liquid feeding connector 21.

Figure 7:
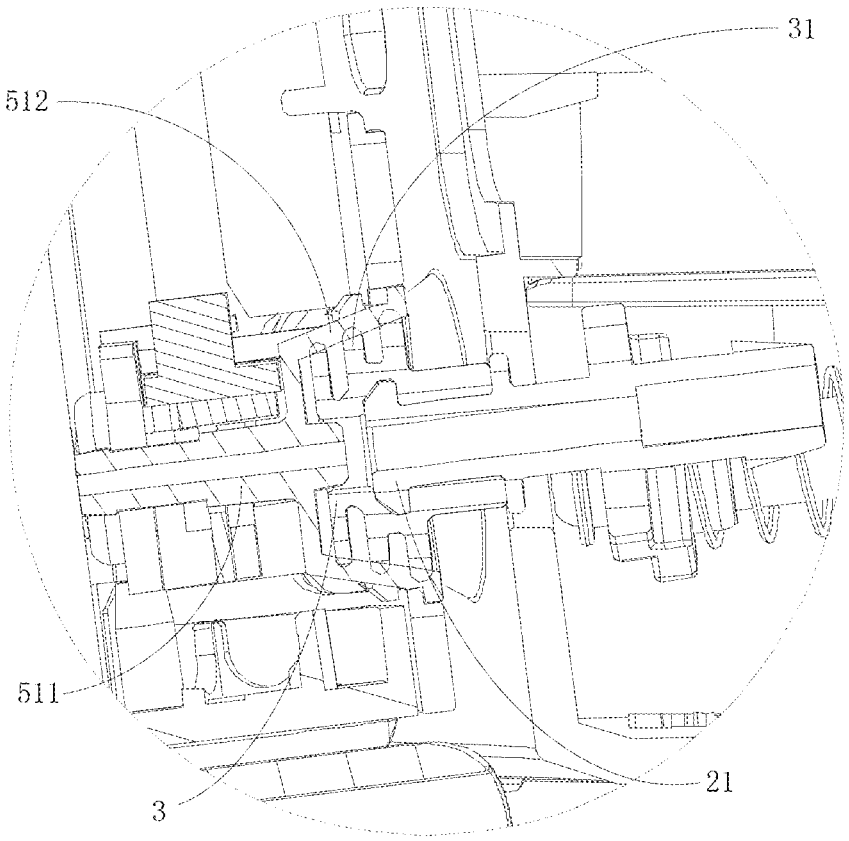
FIG. 7 is an enlarged schematic view of a junction between a connector and a liquid feeding connector in FIG. 6.

Moreover, in order to ensure the sealing reliability, as shown in FIG. 6 and FIG. 7, the first end of the sealing member 3 of the docking station 100 is fitted over the liquid feeding connector 21 and the second end of the sealing member 3 of the docking station 100 extends into the receiving portion 512 and is fitted over the part of the connecting pipe body 511 extending into the receiving portion 512. The second end of the sealing member 3 has a plurality of sealing ribs 31 protruding along a radial direction of the sealing member 3. The plurality of sealing ribs 31 is spaced apart along the length direction of the sealing member 3. In a direction of the connector 51 being inserted into the sealing member 3, the receiving portion 512 is divergent, the plurality of sealing ribs 31 has protrusion heights sequentially increasing, and all the plurality of sealing ribs 31 is in interference fit with the receiving portion 512. That is, in the direction of the connector 51 being inserted into the sealing member 3, the latter sealing rib 31 has a larger protrusion height than the former sealing rib 31. The plurality of sealing ribs 31 and the receiving portion 512 form multi-layer sealing in the direction of insertion, so that the sealing is reliable to ensure that the cleaning device 200 is not prone to water leakage during the liquid replenishment.

The embodiments of the present disclosure further provide a cleaning system. As shown in FIG. 1 and FIG. 2, the cleaning system includes a docking station 100 and a cleaning device 200. The cleaning device 200 can perform cleaning, and the docking station 100 can replenish the cleaning device 200 with the cleaning liquid, so that the cleaning device 200 has a great cleaning effect. Moreover, during the liquid replenishment of the cleaning device 200, the cleaning device 200 is aligned with the docking station 100 precisely and fast, and the junction between the liquid feeding connector 21 and the connector 51 is not prone to water leakage, so that the use experience is great, the liquid replenishment is efficient, and the cleaning efficiency of the entire cleaning system is improved.

The cleaning system may further include a pump body. The pump body is communicated with the connector 51 of the cleaning device 200. When the connector 51 is butted and communicated with the liquid feeding connector 21 of the docking station 100, a suction channel is formed by the pump body, the liquid feeding connector 21, and the connector 51, so that the liquid is pumped into the cleaning device 200 for storage.

Certainly, the pump body may be in the docking station 100 or in the cleaning device 200.

In some embodiments, the pump body is in the cleaning device. The pump body is directly communicated with the connector 51, so that the suction force at the connector 51 is great and the liquid replenishment is fast.

Obviously, the embodiments described above are merely some rather than all of the embodiments of the present disclosure. Based on the embodiments in the present disclosure, changes or variations in other different forms can be made by those ordinary skilled in the art without creative efforts, all of which should fall within the protection scope of the present disclosure.

What is claimed is:

1. A docking station for use in conjunction with a cleaning device, comprising:

a station body having a docking region and a guiding assembly on a side of the station body, the guiding assembly being in the docking region, the docking region being configured to receive the cleaning device, the guiding assembly being configured to be in guiding fit with a mating assembly of the cleaning device; and a liquid feeding assembly on the station body, the liquid feeding assembly comprising a liquid feeding connector, the liquid feeding connector having a liquid outlet oriented toward the docking region, wherein the liquid outlet is configured to be butted and communicated with a connector of the cleaning device under the guiding fit of the guiding assembly and the mating assembly, wherein the guiding assembly comprises a second guiding structure, the second guiding structure is located at a bottom of the docking region, and the second guiding structure is configured to be in guiding fit with a second mating structure of the mating assembly, wherein the second guiding structure is spaced apart from the liquid feeding connector, wherein the station body comprises a base and a cleaning bracket detachable on the base, the docking region is defined by the base, the cleaning bracket is located on a side of the docking region, and the second guiding structure is on the cleaning bracket, wherein the cleaning bracket comprises a filter, the filter has an opening facing downwards and a bottom opposite to the opening, the docking region accommodates at least part of the filter, and the second guiding structure is arranged on the filter, wherein the second guiding structure is a guiding boss, and the guiding boss protrudes outwards from the bottom of the filter towards the liquid feeding connector.

2. The docking station according to claim 1, wherein the guiding assembly comprises a first guiding structure, the docking region has an opening and is configured to receive the cleaning device through the opening, and the first guiding structure comprises a guiding protrusion protruding from the side of the station body where the docking region is toward the opening of the docking region, wherein the first guiding structure is spaced apart from the liquid feeding connector.

3. The docking station according to claim 2, wherein the guiding protrusion is tapered, and a cross section of the guiding protrusion decreases along a direction from the side of the station body where the docking region is toward the opening of the docking region.

4. The docking station according to claim 1, wherein the second guiding structure is configured to be in guiding fit with the second mating structure comprising a guiding chute.

5. The docking station according to claim 4, wherein the cleaning bracket surrounds the side of the docking region, the filter protrudes from a side of the cleaning bracket facing toward the docking region, the filter comprises a plurality of filtering strips spaced apart from each other at the opening, and a gap between two adjacent filtering strips defines a filtering channel.

6. The docking station according to claim 1, further comprising a sealing member, wherein the sealing member has a first end and a second end opposite to each other along a length direction of the sealing member, the first end of the sealing member is fitted over the liquid feeding connector, and the second end of the sealing member is configured to accommodate at least part of the connector of the cleaning device and allow the connector to be communicated with the liquid feeding connector when the cleaning device is parked in the docking region, the second end of the sealing member comprises a plurality of sealing ribs protruding along a radial direction of the sealing member, the plurality of sealing ribs is spaced apart along the length direction of the sealing member, and the plurality of sealing ribs has protrusion heights sequentially increasing from the second end of the sealing member to the first end of the sealing member.

7. The docking station according to claim 1, wherein the liquid feeding assembly further comprises a liquid feeding bracket, the liquid feeding bracket is connected to the station body, the station body has a through hole, and the liquid feeding connector is on the liquid feeding bracket and passes through the through hole into the docking region.

8. The docking station according to claim 7, wherein the liquid feeding assembly further comprises an elastic retractable member having two ends connected to the liquid feeding bracket and the liquid feeding connector respectively.

9. The cleaning device, for use in conjunction with the docking station according to claim 1, comprising:

a cleaning body comprising the mating assembly on a side of the cleaning body, the mating assembly being configured to be in guiding fit with a guiding assembly of the docking station; and a liquid guiding assembly on the cleaning body and comprising the connector, the connector being configured to be butted and communicated with the liquid feeding connector of the docking station, wherein the cleaning device is configured to enter the docking region of the docking station, and the connector is configured to be butted and communicated with the liquid outlet of the liquid feeding connector of the docking station under the guiding fit of the guiding assembly and the mating assembly, wherein the mating assembly comprises the second mating structure, and the second mating structure is at a bottom of the cleaning body and configured to be in guiding fit with the second guiding structure of the docking station, wherein the second mating structure is spaced apart from the connector of the liquid guiding assembly, wherein the mating assembly further comprises a first mating structure, wherein the first mating structure comprises a guiding groove, and wherein the cleaning device further comprises a sensor, and the sensor is arranged at a bottom of the guiding groove, the sensor is configured to be triggered by a first guiding structure of the docking station to send a detection signal when the cleaning device is parked in the docking region of the docking station.

10. The cleaning device according to claim 9, wherein the first mating structure is configured to be in guiding fit with the first guiding structure of the guiding assembly, wherein a direction in which the cleaning device drives into the docking region of the docking station is a forward direction of the cleaning device, and the side of the cleaning body where the mating assembly is located is opposite to the docking station in the forward direction of the cleaning device, wherein the guiding groove is recessed from the side of the cleaning body where the mating assembly is, and wherein the first mating structure is spaced apart from the connector of the liquid guiding assembly.

11. The cleaning device according to claim 10, wherein a cross section of the guiding groove increases along the forward direction of the cleaning device.

12. The cleaning device according to claim 9, wherein the connector comprises a connecting pipe body configured to be communicated with the liquid feeding connector and a receiving portion at an end of the connecting pipe body, and at least part of the connecting pipe body extends into the receiving portion.

13. A cleaning system, comprising:

a cleaning device comprising:

a cleaning body comprising a mating assembly on a side of the cleaning body; and a liquid guiding assembly on the cleaning body and comprising a connector, and a docking station comprising:

a station body having a docking region and a guiding assembly on a side of the station body, the guiding assembly being in the docking region, the docking region being configured to receive the cleaning device, the guiding assembly being configured to be in guiding fit with the mating assembly of the cleaning device; and a liquid feeding assembly on the station body, the liquid feeding assembly comprising a liquid feeding connector, the liquid feeding connector having a liquid outlet oriented toward the docking region, wherein the cleaning device is configured to enter the docking region of the docking station, and the connector is configured to be butted and communicated with the liquid outlet of the liquid feeding connector of the docking station under the guiding fit of the guiding assembly and the mating assembly, wherein the guiding assembly comprises a second guiding structure, the second guiding structure is located at a bottom of the docking region, and the second guiding structure is configured to be in guiding fit with a second mating structure of the mating assembly, wherein the mating assembly comprises a second mating structure, and the second mating structure is at a bottom of the cleaning body and configured to be in guiding fit with a second guiding structure of the docking station, wherein the second guiding structure is spaced apart from the liquid feeding assembly, wherein the station body comprises a base and a cleaning bracket detachable on the base, the docking region is defined by the base, the cleaning bracket is located on a side of the docking region, and the second guiding structure is on the cleaning bracket, wherein the cleaning bracket comprises a filter, the filter has an opening facing downwards and a bottom opposite to the opening, the docking region accommodates at least part of the filter, and the second guiding structure is arranged on the filter, wherein the second guiding structure is a guiding boss, and the guiding boss protrudes outwards from the bottom of the filter towards the liquid feeding connector.

* * * * *